US007197963B1

(12) United States Patent
Flud

(10) Patent No.: US 7,197,963 B1
(45) Date of Patent: Apr. 3, 2007

(54) APPARATUS FOR CLAMPING A DRILLING TUBULAR AGAINST ROTATION

(75) Inventor: Sammy Kent Flud, Brownwood, TX (US)

(73) Assignee: Eagle Rock Manufacturing, LLC, Midland, TX (US)

( * ) Notice: Subject to any disclaimer, the term of this patent is extended or adjusted under 35 U.S.C. 154(b) by 0 days.

(21) Appl. No.: 11/238,329

(22) Filed: Sep. 29, 2005

(51) Int. Cl.
*B25B 17/00* (2006.01)

(52) U.S. Cl. ..... 81/57.19; 81/57.21

(58) Field of Classification Search ..... 81/57.19, 81/57.21, 57.34, 57.44
See application file for complete search history.

(56) References Cited

U.S. PATENT DOCUMENTS 1,462,131 A * 7/1923 Clarke ..... 166/88.2
3,386,726 A * 6/1968 Horst ..... 269/218
4,366,606 A * 1/1983 Willis et al. ..... 269/218
4,475,607 A * 10/1984 Haney ..... 188/67
4,732,061 A * 3/1988 Dinsdale ..... 81/57.34
5,054,550 A * 10/1991 Hodge ..... 81/57.19

* cited by examiner

*Primary Examiner*—Hadi Shakeri
(74) *Attorney, Agent, or Firm*—Buskop Law Group, P.C.; Wendy Buskop

(57) ABSTRACT

An apparatus that can be used during drilling operations for the purposes of clamping and holding drilling tubulars is disclosed. The embodiments relate to machinery that clamp and hold drilling tubulars to allow assembly to a specified torque or disassembly of the tubulars. The apparatus comprises a first grip with teeth inserts housed in a gripping block that opposes a second grip with teeth inserts housed in a second gripping block. The first and second grips are spaced and adapted to accommodate a range of diameters of drilling tubulars. Further, the gripping blocks are held by opposing arms connected to a driving means to create a tightening or loosening movement of the grips and maintain a certain orientation with regard to the tubulars.

12 Claims, 2 Drawing Sheets

APPARATUS FOR CLAMPING A DRILLING TUBULAR AGAINST ROTATION

FIELD

The present embodiments relate to apparatus that can be used during drilling operations. The apparatus can be used for the purposes of clamping and holding drilling tubulars to allow assembly to a specified torque or disassembly of the drilling tubulars.

BACKGROUND

During drilling operations, threaded lengths of drilling tubulars, such as drill pipe and casing, need to be assembled together or disassembled. For example, with drill pipe, the threaded joints between adjacent lengths of drill pipe must be tightened to a specified torque (made up) and then later unscrewed from one another (broken out) during the drilling process.

Though prior art makeup/breakout wrenches have worked efficiently in several applications, a need exists for an apparatus capable of clamping, holding and exerting high level torques on varying diameters of drilling tubulars, without allowing the tubulars to move or slip while clamped and held by the apparatus. More specific, the apparatus must be capable of holding and maintaining a certain orientation of the drilling tubular with respect to the grips of the apparatus to enable the drilling tubulars to be assembled with a required high level torque and to be disassembled safely.

In the use of existing wrenches, the problem of slippage between the tubular and the makeup/breakout wrenches has existed and is particularly acute in connection with small diameter drilling tubulars, where extremely high levels of friction between the jaws of the makeup/breakout wrenches and the drilling tubulars may be required.

The present embodiments meet these needs.

BRIEF DESCRIPTION OF THE DRAWINGS

The detailed description will be better understood in conjunction with the accompanying drawings as follows.

Figure 1:
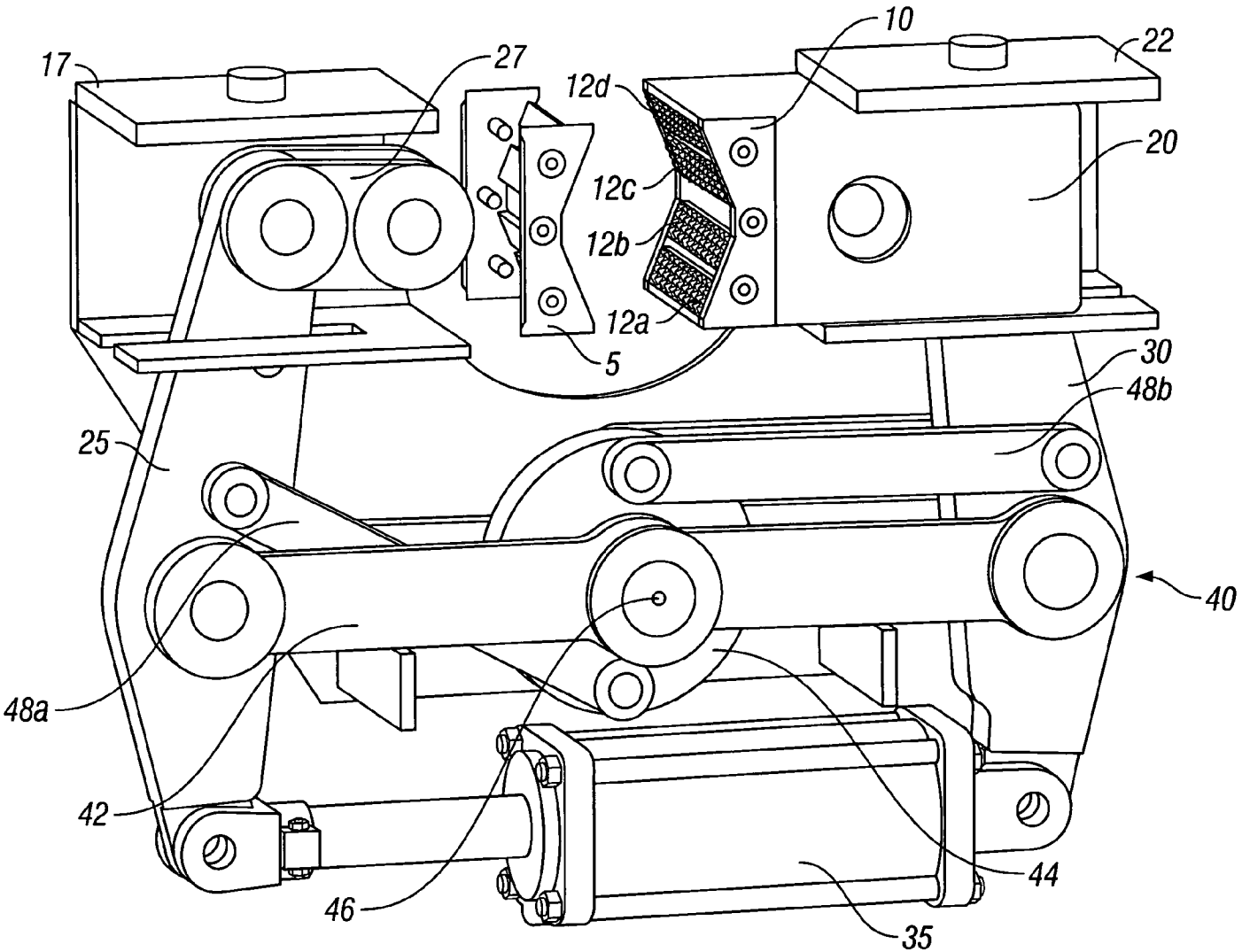
FIG. 1 depicts a side, perspective view of an embodiment of an apparatus for clamping a drilling tubular against rotation.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that it can be practiced or carried out in various ways.

The present embodiments relate to an improved clamp that can be used during drilling operations. The present embodiments have inserts for clamping and holding drilling tubulars, such as drill pipe. The embodied clamp utilizes a double-push link to ensure that the arms holding the grips move in a plane perpendicular to the drilling tubular. The embodied clamps are particularly useful in connection with makeup and breakout wrenches used with drilling rigs for drilling bore holes in earth formations.

The present embodiments are devices that provide strong clamping assemblies without the use of a slot. The present embodiments can clamp the tubulars with out the need of inserts, chokes, or spacers. The embodiments are more reliable because of the lack of movement of the frame.

The embodied clamping devices are adapted to accommodate a range of diameters of drilling tubulars. For example, the clamping device can accommodate drilling tubulars ranging from about 2 inches in diameter to about 14 inches in diameter.

The embodied clamping apparatus includes two or more grips. If two grips are used, the grips are located on opposite sides of the drilling tubular. Each grip is located in a grip block.

Each grip includes a receiving recess with one or more inserts. Each insert includes a plurality of teeth to clamp the drilling tubular and to provide high levels of friction. The teeth can be orientated in a variety of orientations. For example, the teeth can be orientated in a first orientation adapted for clockwise rotation of the drilling tubular, a second orientation adapted for counter-clockwise rotation of the drilling tubular, a third orientation parallel to the drilling tubular, a fourth orientation perpendicular to the drilling tubular, or in an asymmetrical orientation.

The insert can be fixed in the grip or can be rotatably positioned within the recess. The teeth on the face of the insert can extend beyond the face of the grip to contact and frictionally engage the tubular. If the inserts are rotatably positioned within the recess, means are provided for positioning the insert in the recess such that the insert is free to rotate within the recess through a selected range to allow the toothed surface to orient into contact with the tubular, yet the insert is impeded from rotating beyond the selected range.

Each grip block is a housing that includes two or more connectors that attach the grip block to an arm. The connectors in the grip block allow the user to position the grip and inserts so that the grip and inserts are perpendicular to the drilling tubular. The grip block can include a linkage in order to allow the grip and the inserts to be a set distance from the arm.

The embodied clamping devices include a driving means attached to the arms. The driving means is used to move the grip blocks towards and away form the drilling tubulars. An example of a driving means is a dual hydraulic cylinder. Other examples of driving means can include a makeup and breakout wrench.

The embodied clamping devices include a double-push link connected to the two arms that each connect to the grip blocks. The double-push link ensures that the grips move in a plane perpendicular to the drilling tubular. By ensuring the grip blocks move in a plane perpendicular to the drilling tubular, the embodied clamping device provides the benefit of allowing the grips to be readily configured to exert maximum frictional forces against the different diameters of tubulars, regardless whether the clamp is being used to rotate the tubular in a clockwise or alternatively a counter-clockwise direction. Further, by moving in the same plane, the embodied clamps can orient itself as necessary to conform to the surface of the various diameters of tubulars in order to maximize the contact area between the teeth of the insert and the clamped tubular.

An embodiment of the double-push link includes a brace that connects to the two arms. The brace includes a hole in the midpoint. A disc with a center hole is aligned to the hole in the brace. A pivot cylinder is disposed through the midpoint hole in the brace and the center hole of the disc.

The pivot cylinder allows the disc to rotate. For each arm, a link is connected to the disc and to the arm.

The embodied clamping devices can include a frame to house and support the grip blocks, the arms, the driving means, and the double-push link. The embodied clamping devices can include a protective plate to cover the grip blocks, the arms, the driving means, and the double-push link.

The embodied clamps can be useful in connection with makeup/breakout devices. Such devices are used to tighten and loosen threaded connections between adjacent lengths of tubulars, such as drill pipe. The embodied clamp and design of moving the clamps in one plane perpendicular to the tubular provide an excellent frictional engagement between the clamp and the clamped tubular in order to provide the high torque needed to break threaded connections between adjacent drilling tubulars in some applications.

Figure 2:
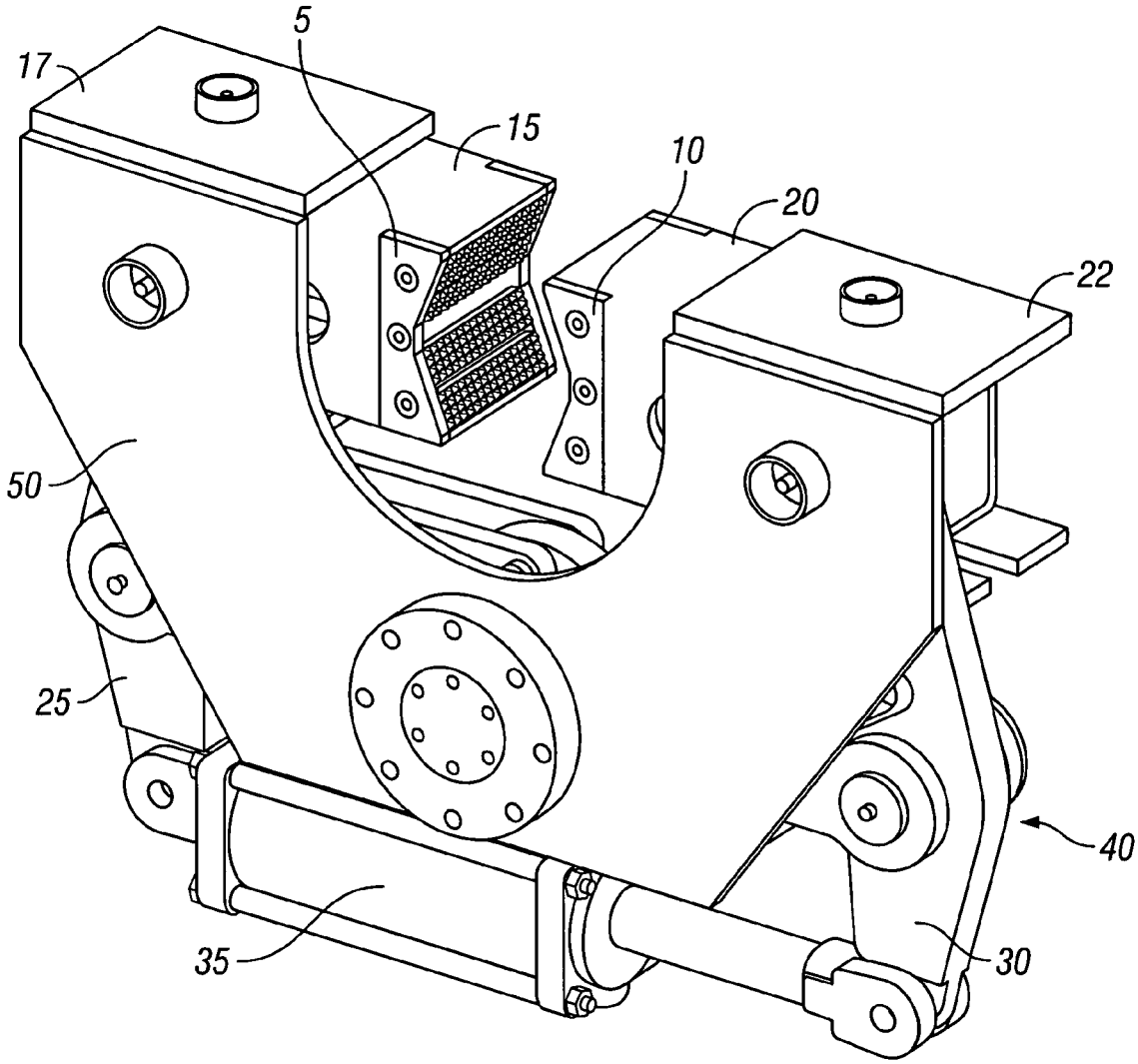
FIG. 2 depicts the opposite side, perspective view of the embodiment depicted in FIG. 1.

With reference to the figures, FIG. 1 depicts a side, perspective view of an embodiment of an apparatus for clamping a drilling tubular against rotation. FIG. 2 depicts the opposite side, perspective view of the embodiment depicted in FIG. 1.

FIG. 1 depicts an embodiment with a first grip (5) and a second grip (10) located opposite of one another. The first and second grips (5 and 10) have a recess that allows the first and second grips (5 and 10) to fit around a drilling tubular.

FIG. 1 depicts the second grip (10) in the second grip block (20). The first grip block (15), is depicted in FIG. 2, but shown in FIG. 1 as cutaway. The grip can be connected to the grip block in various manners. FIG. 1 and FIG. 2 depict the embodiment wherein the grip is fastened to the grip block using bolts. Examples of other fasteners include screws, pin connections, or welding.

The grip blocks can be connected directly to the arm as shown in FIG. 1, wherein the second grip block (20) is connected to the second arm (30). The grip block can be connected to the arm in various manners. Examples of other fasteners include screws, pin connections, or welding. As shown in FIG. 1 and FIG. 2, the grip blocks (15 and 20) can each be located in a respective guide (17 and 22). The guides (17 and 22) aid in ensuring that the grip blocks (15 and 20) move in the same plane perpendicular to the drilling tubular.

Alternatively, an arm extension or linkage (27) can be used. FIG. 1 depicts the embodiment wherein the linkage (27) is used with the first arm (25). The linkage (27) can be used in order to allow the grip (5) and the inserts to be a set distance from the arm. The linkage (27) can be used to ensure that the grip and the grip block remain in a plane perpendicular to the drilling tubular. As shown in FIG. 1, the linkage (27) can have two connections which are rotatable.

The grips (5 and 10) can have one or more inserts to grip the drilling tubular. FIG. 1 and FIG. 2 depict the embodiment, wherein each grip (5 and 10) includes four inserts (12*a*, 12*b*, 12*c*, and 12*d*). Each insert can have a plurality of teeth in various orientations to aid in gripping the drilling tubular. The figures depict the embodiment, wherein the teeth are in an orientation perpendicular to the drilling tubular.

Continuing with FIG. 1 and FIG. 2, the grip blocks (15 and 20) are each connected to an arm (25 and 30). The arms (25 and 30) are connected to a driving means (35). The driving means (35) depicted in the figures is a dual hydraulic cylinder. The driving means (35) applies force to the arms (25 and 30) in order to force the grip blocks (15 and 20) and grips (5 and 10) to engage and disengage the drilling tubular. The driving means (35) can be connected to the arms (25 and 30) in various manners. FIG. 1 and FIG. 2 depict the embodiment wherein the driving means (35) is fastened to the arms (25 and 30) using pin connections. Examples of other fasteners include screws or welding.

A double-push link (40) is used to ensure that the grip blocks (15 and 20) and grips (5 and 10) move in the same plane perpendicular to the drilling tubulars. As depicted in FIG. 1, the double-push link (40) includes a main brace (42). The main brace (42) is connected to the first and second arms (25 and 30). The main brace (42) includes a hole near the midpoint. As depicted in FIG. 1, the double-push link (40) includes a disc (44). The disc (44) includes a hole in the center. A pivot cylinder (46) is disposed in the midpoint hole in the main brace (42) and the center hole in the disc (44). The pivot cylinder (46) allows the disc to rotate. A first linking arm (48*a*) is connected to the first arm (25) and the disc (44). A second linking arm (48*b*) is connected to the second arm (30) and the disc (44).

As depicted in FIG. 2, the apparatus for clamping a drilling tubular can include a face plate (50) to protect the apparatus during use.

While these embodiments have been described with emphasis on the preferred embodiments, it should be understood that within the scope of the appended claims, the embodiments might be practiced other than as specifically described herein.

What is claimed is:

1. An apparatus for clamping a drilling tubular comprising:

a. a first grip and a second grip adapted to clamp the drilling tubular;

b. a first grip block, housing the first grip, and a second grip block, housing the second grip, c. the first grip block is connected to a first arm by means of a first linkage and the second grip block is connected to a second arm by means of a second linkage;

d. the first arm is operatively disposed within a slot disposed in a first guide, and the second arm is operatively disposed within a slot disposed within a second guide;

e. the first linkage and the second linkage are adapted to move in a plane perpendicular to the drilling tubular to open and close the first grip and the second grip, enabling the first arm and the first linkage to simultaneously slide through the first guide and the second arm and the second linkage to simultaneously slide through the second guide;

f. a double-push link connected to the first arm and the second arm, wherein the double-push link is adapted to move each grip in a plane perpendicular to the drilling tubular; and g. a drive means connected to the first arm and the second arm.

2. The apparatus of claim 1, wherein the first grip and the second grip are adapted to accommodate a range of diameters of drilling tubulars.

3. The apparatus of claim 2, wherein the range of diameters of drilling tubulars is from about 2 inches to about 14 inches.

4. The apparatus of claim 1, wherein the first grip and the second grip are located on opposite sides of the drilling tubular.

5. The apparatus of claim 1, wherein each grip comprises a receiving recess with at least one insert.

6. The apparatus of claim 5, wherein each insert comprises a plurality of teeth.

7. The apparatus of claim 1, wherein each connector is a pin connection.

8. The apparatus of claim 1, wherein double-push link comprises:

a. a brace, wherein the brace is connected to the first arm and the second arm, wherein the brace comprises a midpoint hole;

b. a disc with a center hole;

c. a pivot cylinder disposed through the midpoint hole and the center hole, wherein the pivot cylinder attaches the brace to the disc, and wherein the pivot cylinder is adapted to allow the disc to rotate; and d. a first link and a second link, wherein the first link is connected to the first arm and the disc, and wherein the second link is connected to the second arm and the disc.

9. The apparatus of claim 1, wherein the drive means is a hydraulic cylinder.

10. The apparatus of claim 1, wherein the drive means is connected to the first arm using a first pin connection and is connected to the second arm using a second pin connection.

11. The apparatus of claim 1, further comprising a frame adapted to house the first grip block, the second grip block, the double-push link, and the drive means.

12. The apparatus of claim 1, further comprising a protective plate adapted to cover the first grip block, the second grip block, the double-push link, and the drive means.

* * * * *